United States Patent [19]

DeCarlo

[11] Patent Number: 4,730,407

[45] Date of Patent: Mar. 15, 1988

[54] SYSTEM FOR CONVERTING FIREARMS TO ELECTRICAL IGNITION

[76] Inventor: Dean S. DeCarlo, D & I Carbide, 200 Industrial Dr., Port Richey, Fla. 33568

[21] Appl. No.: 35,600

[22] Filed: Apr. 7, 1987

Related U.S. Application Data

[63] Continuation-in-part of Ser. No. 774,307, Sep. 10, 1985, abandoned.

[51] Int. Cl.[4] ..... F41C 19/12

[52] U.S. Cl. ..... 42/84

[58] Field of Search ..... 42/84; 89/28.05, 28.1

[56] References Cited

U.S. PATENT DOCUMENTS

| | | | |
|---|---|---|---|
| 2,957,391 | 10/1960 | Lovercheck | 89/28.05 |
| 3,044,204 | 7/1962 | Zimmerman | 42/84 |
| 3,854,231 | 12/1974 | Broyles | 42/84 |
| 4,347,679 | 9/1982 | Grunig et al. | 42/84 |

*Primary Examiner*—Charles T. Jordan

*Attorney, Agent, or Firm*—Z. T. Wobensmith, III

[57] ABSTRACT

A system for converting firearms to electrical ignition for firing of electrically primed ammunition. The system includes a drop in module to replace the conventional trigger, hammer pin, and other firing mechanism parts, and which has either included or separate structure to replace conventional firing pins. The module contains a safety interlock system, indicator lights, an on-off switch, an actuator switch, ammunition contacts and appropriate connecting circuitry to a power supply means.

7 Claims, 7 Drawing Figures

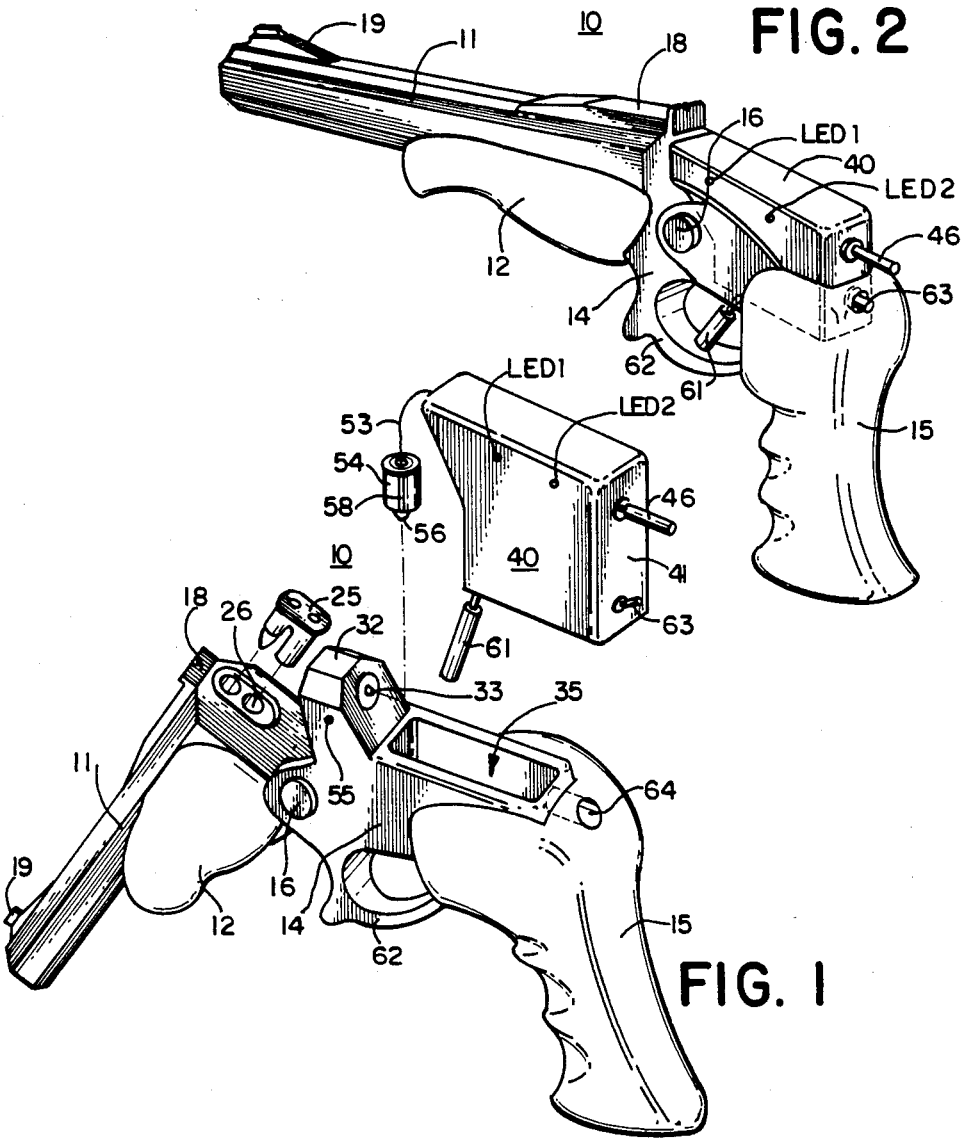
FIG. 2
FIG. 1
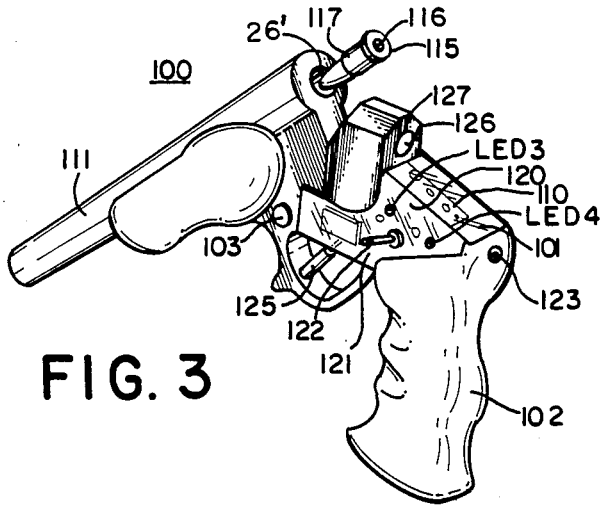
FIG. 3

SYSTEM FOR CONVERTING FIREARMS TO ELECTRICAL IGNITION

CROSS-REFERENCE TO RELATED APPLICATIONS

This application is a continuation-in-part of my prior U.S. application Ser. No. 774,307, filed Sept. 10, 1985, entitled "System for Converting Firearms to Electrical Ignition", now abandoned.

BACKGROUND OF THE INVENTION

1. Field of the Invention

This invention relates to a system for converting firearms to electrical ignition, of the type which provides a drop in module to replace the conventional mechanical firing mechanism, and may include a safety interlock system to prevent accidental or unauthorized use.

2. Description of the Prior Art

The use of electric ignition for igniting bullet propellant materials in firearms has been considered and utilized in various forms for some time. Considerable research has been conducted on systems to initiate combustion of the propellant which systems electrically move the firing pin, or which utilize cartridges that contain electrically initiated primers, or which provide a separate ignition system similar to a conventional spark plug in a firing chamber. Examples of such structures are disclosed in U.S. Pat. Nos. 1,108,717 to C. Davis; 2,926,566 to W. W. Atkins et al.; 3,490,332 to C. A. Damm; 3,563,177 to H. W. Ritchey; 3,608,492 to J. W. Mitchell; 3,613,282 to M. Ramsay; 3,650,174 to T. S. Nelsen; 3,685,392 to W. G. Platt; 3,982,347 to Brandl et al.; 4,109,557 to C. D. Zaucha; and 4,148,245 to Steffanus et al.

A prime consideration to firearm users, and in particular when a high degree of accuracy is desired, is the avoidance of flinching or jerking when pulling the trigger. Most persons have a natural tendency to flinch or jerk the trigger of the firearm because they are afraid of the noise and attendant recoil of firearms. The inertial forces of the released hammer, bolt, or firing pin attendant upon their release in and of themselves can also contribute to jerking and consequent loss of accuracy.

Various trigger mechanisms have been provided which attempt to smooth out trigger pull and to reduce the inherent let off and jerking tendency. Target shooters and competitors are particularly cognizant of these problems and place considerable emphasis on correct trigger response and pull to achieve desired accuracy.

None of the prior art patents provides a simple system for converting conventional firearms to electronic ignition by replacement of the conventional firing mechanism, with a system having a high degree of safety and that provides a smooth effortless let off without any tendency to jerking, and is also available for firearms that are well known and used by many persons.

SUMMARY OF THE INVENTION

In accordance with the invention a system for converting firearms to electrical ignition is provided for the firing of electronically primed ammunition, and which replaces the conventional mechanical firing mechanism, which system includes a drop in module containing safety interlock provisions, indicator lights, on-off and actuator switches, ammunition contacts, appropriate circuitry, and an integral or independent power supply.

Structure is also provided to replace the conventional firing pin, which structure can be integral or separate from the module.

The principal object of the invention is to provide a system for converting firearms to electrical ignition which can be readily adapted to may types of conventional firearms.

A further object of the invention is to provide a system of the character aforesaid which is fast and positive in operation.

A further object of the invention is to provide a system of the character aforesaid which can provide considerable improvement in accuracy by firearm users.

A further object of the invention is to provide a system of the character aforesaid which can be used with conventional or U-shaped electronically primed ammunition.

A further object of the invention is to provide a system of the character aforesaid which can be used with firearms having a fixed or reciprocating bolt or breech block.

A further object of the invention is to provide a system of the character aforesaid which results in a reduction in the number of machined parts from those normally contained in a conventional firearm.

A further object of the invention is to provide a system of the character aforesaid which may be provided with a unique safety interlock system.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which:

FIG. 1 is an exploded perspective view of one embodiment of the system of the invention for use in a single shot fixed breech block firearm, shown in open position and for use with U-shaped electrically primed ammunition;

FIG. 2 is a view similar to FIG. 1 but showing the system assembled and the breech block closed;

FIG. 3 is a view similar to FIG. 1 for a single shot fixed breech block firearm, illustrating another embodiment of the invention, in open position and for use with conventional electrically primed ammunition;

It should, of course, be understood that the description and drawings herein are illustrative merely and that various modifications and changes can be made in the structure disclosed without departing from the spirit of the invention.

DESCRIPTION OF THE PREFERRED EMBODIMENTS

Figure 6:
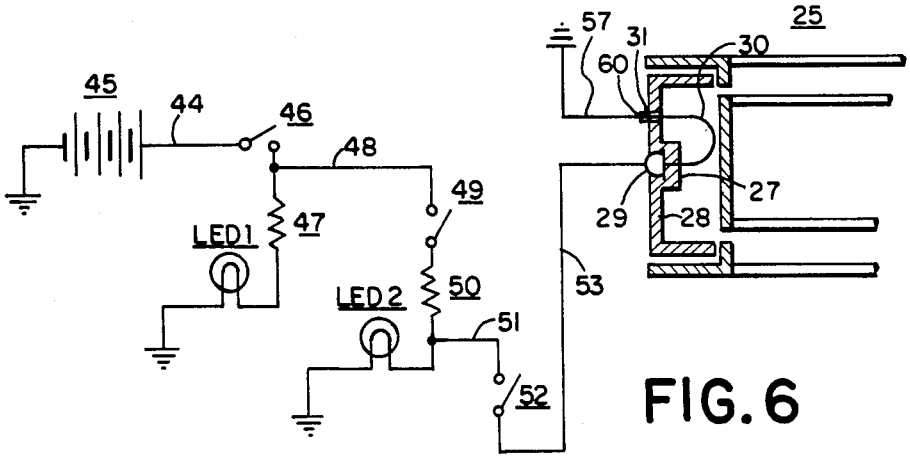
FIG. 6 is a schematic diagram of the electrical circuitry of the system of the invention used for the firearm of FIGS. 1, 2, and 3.

Referring now more particularly to the drawings and FIGS. 1, 2, and 6, inclusive, a pistol 10 is therein illustrated which has a barrel assembly 11, forearm 12, frame 14, grip 15, and with a pin 16 through the frame and barrel assembly, permitting rotation of the barrel to open and closed position.

The barrel assembly 11 has a rear sight assembly 18 and a front sight assembly 19 on the top thereof. The barrel assembly 11 and frame 14 also includes a latch assembly (not shown) of well known type to lock the barrel in closed position as shown in FIG. 2.

The pistol 10 is representative of many target pistols and as illustrated is an x-caliber single action pistol available from Sterling Arms Corp. of Tonawanda, N.Y. As shown in FIG. 1, the pistol 10 has been chambered to use U-shaped ammunition such as that disclosed in the U.S. Pat. Nos. 3,857,733; 3,861,308; and 3,913,446 to Andrew J. Grandy and a round of such U-shaped ammunition 25 is shown prior to insertion into the chamber 26 of pistol 10. The round 25 is preferably molded of synthetic plastic and has an exposed first metallic contact 27 in the rear wall 28, to which is connected a coil of high resistance wire 30, of any suitable type, with tungsten wire of 0.003 inch diameter being particularly suitable, and available from GTE-Sylvania, Towanda, Pa. The coil of wire 30 is also connected to a second exposed metallic contact 31 in rear wall 28 of round 25. The frame 14 of pistol 10 has an integral fixed breech block portion 32, which has a passageway 33 therethrough, which normally contains a firing pin (not shown), which has also been removed for the conversion to be described. A drop in module 40 is illustrated above the recess 35 of pistol 10, of rectangular configuration, and with an exterior housing 41 preferably constructed of insulated molded synthetic plastic such as filled nylon, and which can be contoured to fit into recess 35.

The module 40, with the circuitry embodiment shown in FIG. 6, contains a battery 45 connected to ground, which can be of any suitable type, with a rechargeable nickel cadmium battery of well known type providing 1.5 volts being preferred, but other batteries can be used as desired. The battery 45 is connected by wire 44 through a bank of safety interlock switches 70 to be described, to an on-off switch 46, which is connected by a resistor 47 to a light emitting diode LED 1 which is connected to ground and which is of well known type, and when energized provides a red light when switch 46 is closed. The resistor 47, in the preferred embodiment, can have a value of 100 ohms. The switch 46 has another wire 48 connected thereto, and to a grip safety switch 49 which is connected by a resistor 50 to another light emitting diode LED 2 which is also connected to ground and which provides a green light when switch 49 is closed. The resistor 50 has a wire 51 connecting it to a trigger switch 52, which has a wire 53 connected thereto, and to a plug 54 which fits into the passageway 33 and is retained therein by screw 55 in groove 58. The plug 54 has an energizing contact 56 connected to wire 53, which can engage the first metallic contact 27 of round 25, when barrel assembly 11 is in the closed locked condition of FIG. 2. A wire 57 is also connected to the plug 54, and to a ground contact 60, which can engage the second metallic contact 31 of round 25, when the pistol 10 is in closed locked condition.

In order to provide a high degree of safety and to prevent unauthorized use of the firearm, additional safety provisions in the form of a safety interlock system are incorporated into the module. These safety provisions include a bank of single pole double throw switches 70, connected to wire 44 by wire 71 and by wire 72 to switch 46, which may be internally connected to provide a system that requires that the switches be in a predetermined position to coincide with the internal circuitry (not shown). The appropriate switch position, for example, for FIG. 6 to provide for operation would be − − + − + + − −. No other positions of the switches 70 would provide for connection through the switches 70 when wired in the sequence of FIG. 6. In the example of FIG. 6 eight switches 70 are illustrated which provides some 256 different combinations.

The trigger switch 52 has an arm 61 which, in assembled condition, extends through an opening (not shown) in frame 14 into an opening formed by the trigger guard 62 of the frame 14 for engagement by the finger (not shown) of the user. The grip safety switch 49 has an actuator button 63 which extends through an opening 64 in the grip 15 for engagement by the hand (not shown) of the user.

Referring now more particularly to FIG. 3, a pistol 100 similar to pistol 10 is therein illustrated, with a frame 101, grip 102, pin 103, and a barrel assembly 111 which has a chamber 26' for use with a conventional type metallic cased round of electrically primed ammunition 115. The pistol frame 101 normally has a side plate (not shown) which is one side of the frame 101 to provide a recess (not shown) similar to recess 35 of pistol 10.

A drop in module 120 is provided, which fits into the recess 110 of pistol 100, with an outer housing 121, on-off switch 122, grip safety switch 123, a red on-off light emitting diode LED 3, a green safety light emitting diode LED 4, and a trigger switch assembly 125.

The circuitry of module 120 is the same as that shown in FIG. 6 with a plug 126 which fits into a passageway 127 in frame 101.

The plug 126 is provided with first and second metallic contacts (not shown) which engage an exposed contact 116 of round 115, and the metallic casing 117. The round 115 has a coil of wire (not shown) similar to coil 30 connected thereto inside of its metallic outer casing 117. Operation of the pistol 100 with module 120 is as described for pistol 10.

Figure 4:
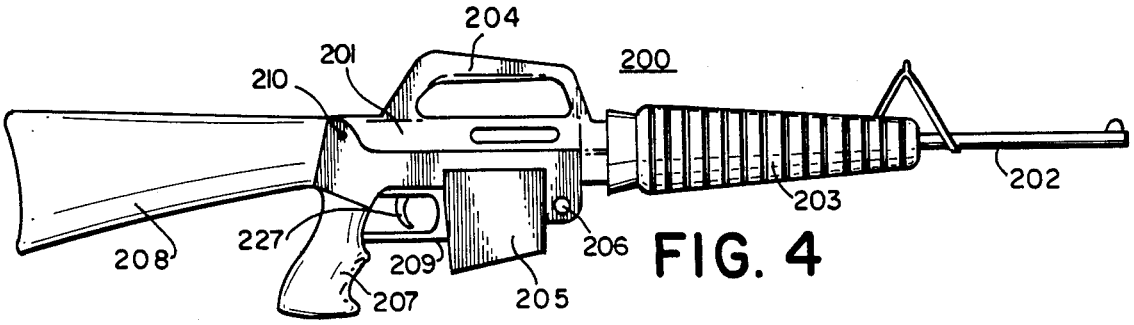
FIG. 4 is a side elevational view of an M-16 rifle with another embodiment of the system of the invention installed therein.
Figure 5:
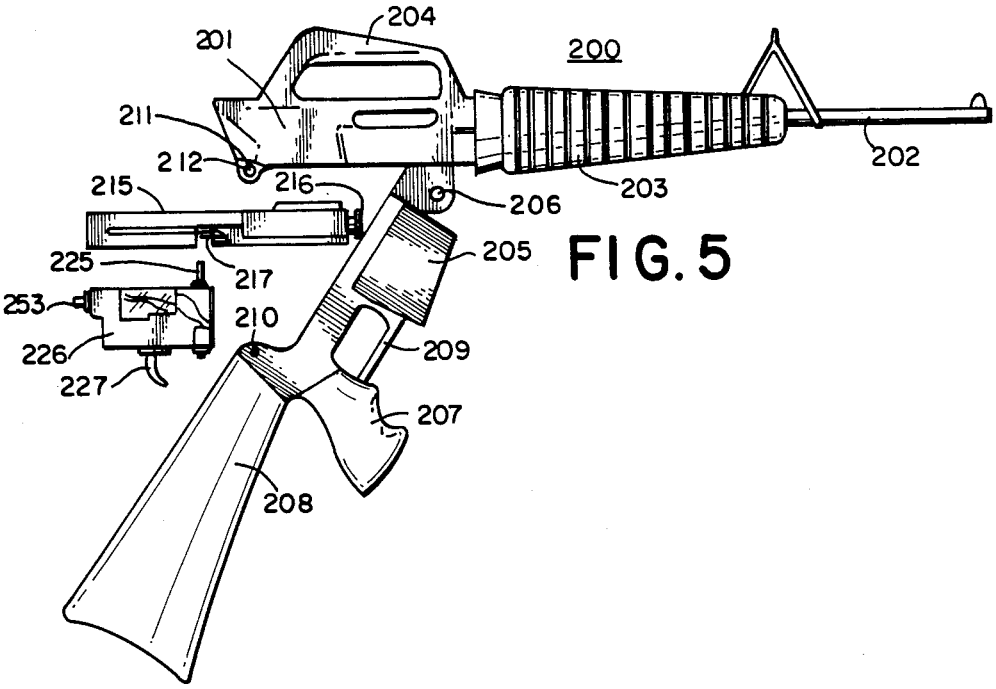
FIG. 5 is a side elevational view of the rifle of FIG. 4 with the receiver open and with the module of the invention and the bolt assembly of the rifle prior to assembly into the rifle.
Figure 7:
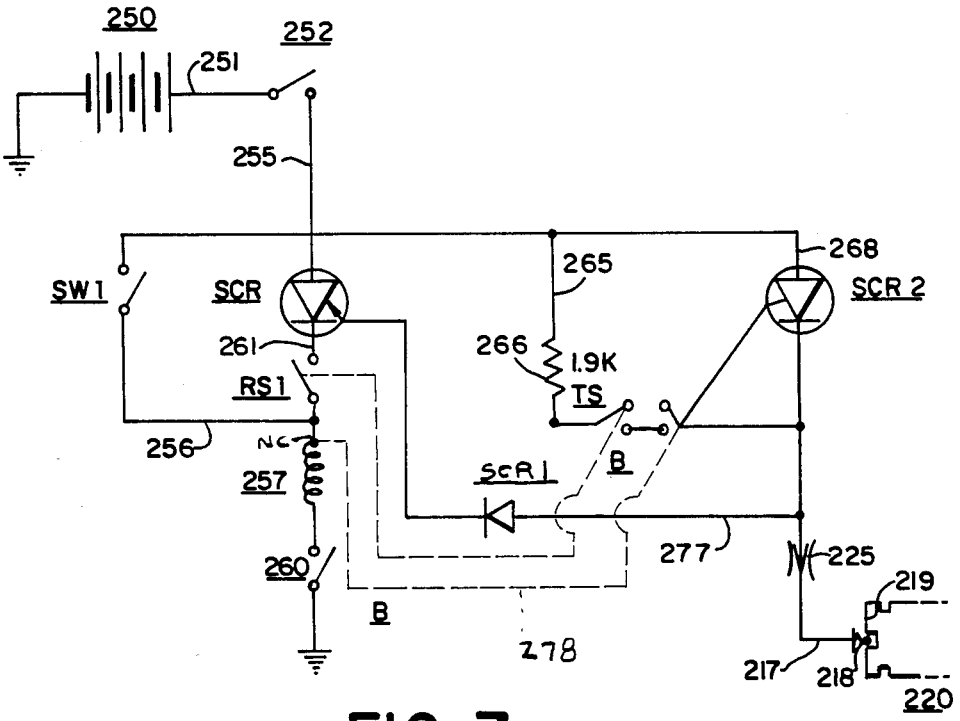
FIG. 7 is a schematic diagram of the electrical circuitry of the system of the invention as used in the embodiment of FIGS. 4 and 5.
Figure 4:
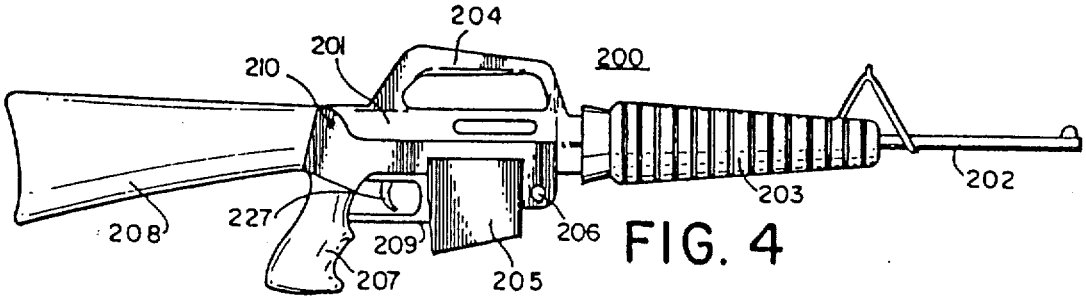
Figure 5:
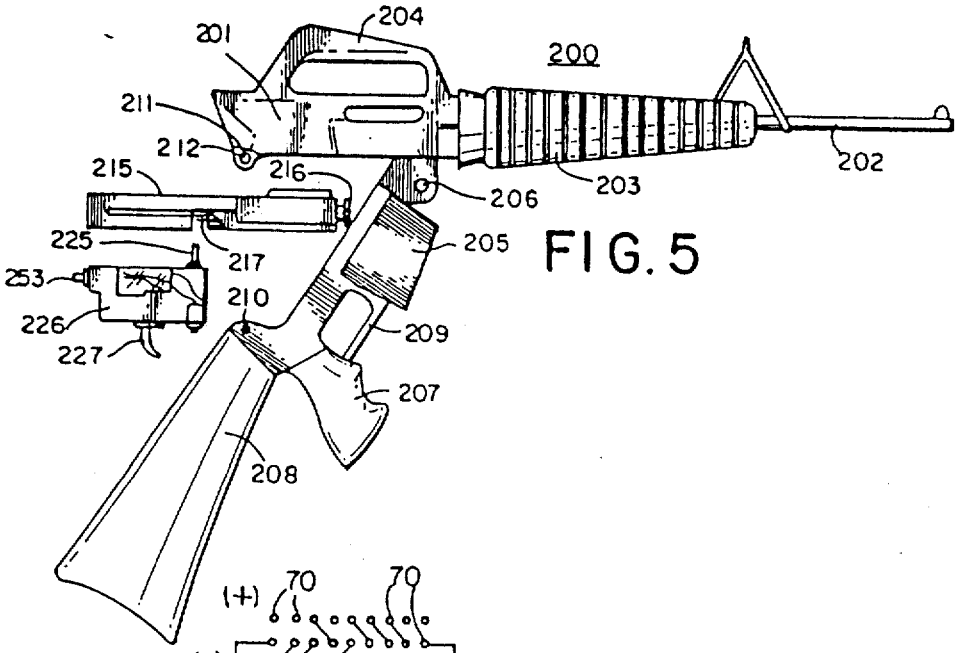
Figure 6:
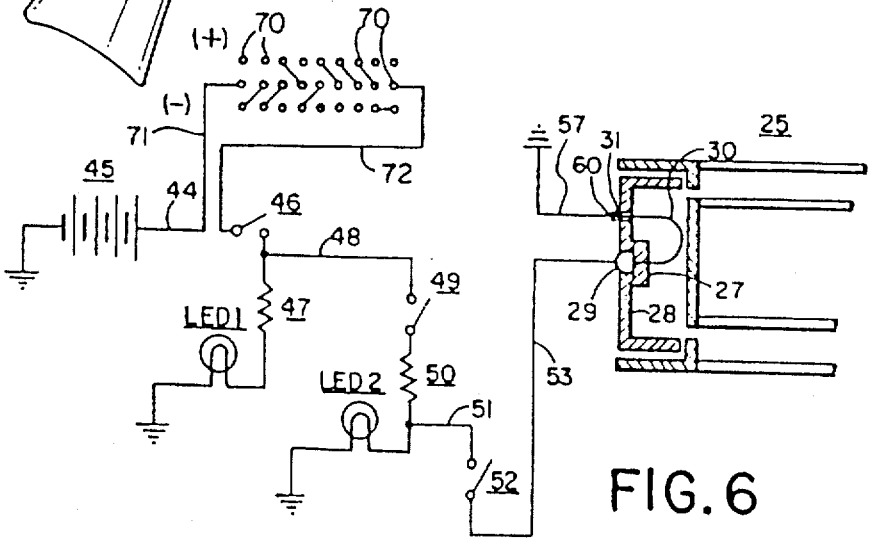
Figure 7:
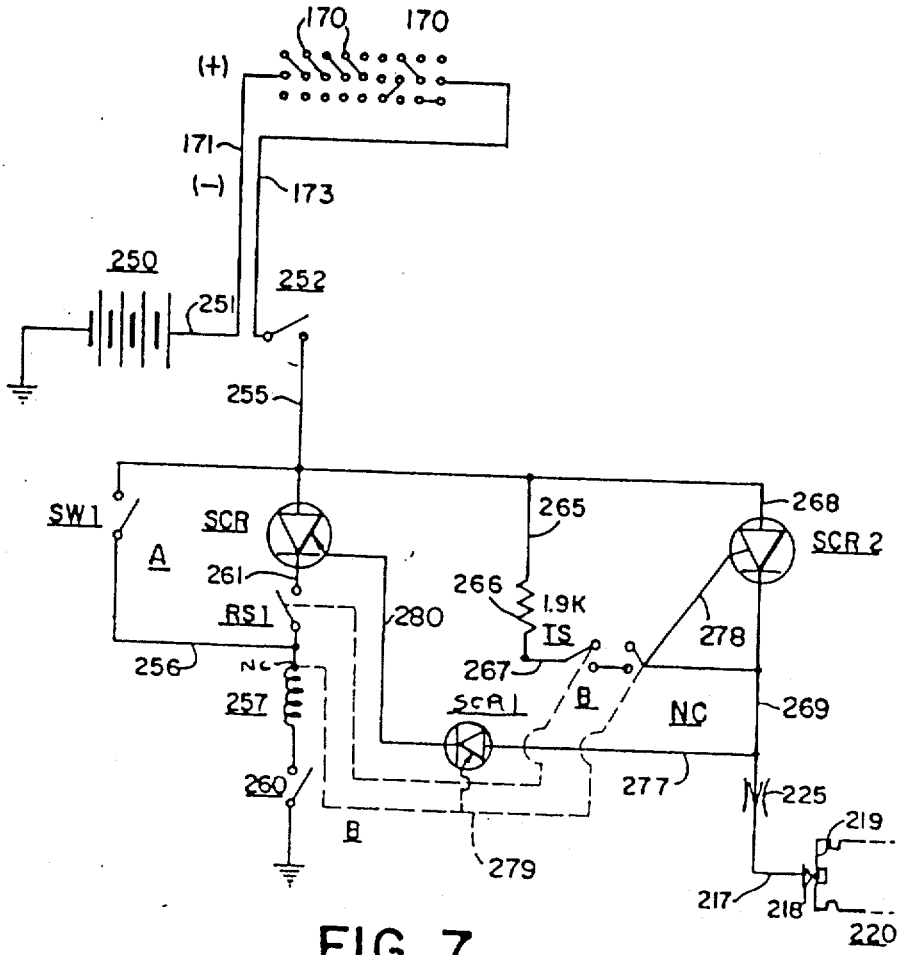

Referring now more particularly to FIGS. 4, 5, and 7, another embodiment of the system of the invention is therein illustrated. In FIGS. 4 and 5 a rifle 200 is illustrated which may be of the M-16 semi and full automatic type, available from Colt Industries, Inc., Hartford, Conn., and which is the standard military rifle of the armed forces of the United States.

The rifle 200 has an upper receiver 201 with a barrel 202, forearm 203, carrying handle 204, and which upper receiver is fastened to a lower receiver 205 by a pivot pin 206.

The lower receiver 205 has a hand grip 207, a butt stock 208, and a trigger guard 209. The lower receiver 205 and upper receiver 201 can be locked together by a pin 210 in lower receiver 205, which engages an opening 211 in extension 212 of upper receiver 201.

In FIG. 5, the pin 210 has been retracted and lower receiver 205 has been pivoted downwardly from upper receiver 201, and the bolt carrier 215 and bolt 216 removed. The bolt 216 is provided with an insulated wire 217 running its length and with a contact 218 at the face of the bolt 216 for contact with a metallic contact 219 of an electrically primed round 220 shown in FIG. 7. The wire 217 extends rearwardly to and past the end of bolt 216 for engagement with a spring loaded contact 225 from a drop in module 226. The drop in module 226 is provided with a trigger 227 for actuation by a finger (not shown) of a user.

Referring now also to FIG. 7, the electrical circuitry contained in module 226 is therein illustrated. The circuitry includes a battery 250 which may be of the same type as battery 45, and one side of which is connected to ground. The battery 250 is connected by a wire 251 through a bank of safety interlock switches 170 (to be described), to a grip safety switch 252 which has a spring loaded shaft 253 which extends through the hand grip 207 for engagement by the hand (not shown) of the user preparatory to use. The switch 252 is connected by a wire 255 to a thermal switch SW1 which is connected by a wire 256 to a relay coil 257, which is connected to a mode controlling switch 260, which when open, permits the rifle to be fired in the full automatic mode, and when closed, in the semi-automatic mode as described below. The wire 255 is also connected to one side of a first silicon controlled rectifier SCR which is connected by wire 261 to a relay switch RS1 which also has wire 256 connected thereto. Wire 255 has a wire 265 connected thereto, and to a resistor 266 which may be of 1.9k ohms resistance and which is connected by wire 267 to trigger switch TS, which can actuate switch RS1. A wire 268 is also connected to wire 265, and to one side of a second silicon controlled rectifier SCR 2, which is connected by a wire 269 to contact 225, which engages wire 217 from the contact 218, which engages contact 219 from the round 220.

The gate of silicon controlled rectifier SCR2 is connected by wire 278 to one contact NC of relay 257, and the other relay contact is connected to trigger switch TS as described above.

The rectifier SCR2 has another wire 277 which connects it to a silicon controller rectifier SCR1, and which is connected by wire 280 to the gate of silicon controlled rectifier SCR.

In order to provide for added safety and security, a bank of safety interlock switches 170 is provided as described for switches 70 of FIG. 6. The bank of switches 170 is connected to wire 251 by wire 171 and to switch 252 by wire 173, the internal connections of the switches 170 can be as desired and for switches 170 of FIG. 7 the appropriate position of the switches 170 for operation is ++++−+−−.

It should be noted that while the power supply for the modules described above is illustrated as a self-contained battery, the power supply can be external and could be from a vehicle power supply or any other fixed or portable external supply as desired.

The mode of operation will now be pointed out.

Referring to FIGS. 1, 2, 3, and 6, when operation of the pistols 10 or 100 is desired, and assuming the modules 40 and 120 are in place, the safety interlock switches 70 are set in their predetermined positions for operation, the on-off switch 46 or 122 is engaged and light emitting diodes LED 1 or LED 3 are energized, providing an indication that the system is ready. The grip 15 or 102 of pistol 10 or 100 is grasped by the user's hand (not shown), and grip safety switch 49 actuated, thereby energizing light emitting diode LED 2 or LED 4 indicating the pistol is ready to fire.

The trigger 61 or switch 125 is engaged by the user's finger (not shown), and switch 52 or 125 is engaged closing the respective switch and causing electricity to flow to the electrical primer in the round of ammunition 25 or 115, which heats the coil 30 to cause combusion of the bullet propellant. The pistol 10 or 100 can be reloaded and firing continued as desired.

Referring now to FIGS. 4, 5, and 7, when it is desired to fire rifle 200, safety switches 170 are set in the predetermined positions, the semi or full automatic mode is chosen, and switch 260 opened or closed as required. If the semi-automatic mode is chosen, then switch 260 is closed, thereby energizing relay 257 with each round fired. The relay 257 opens the contacts "B" and will not permit the gun to be fired until the trigger is released.

The rifle 200 is gripped by the user, thereby closing switch 252, and making a circuit from battery 250 through SCR. Trigger switch TS is contacted, which closes switch RS1, to apply a positive voltage from resistor 266 through wire 278 to the gate of SCR2, causing it to conduct, thus completing the circuit through SCR2 to the wire 217 to round 220. When SCR2 conducts, a positive voltage appears at the junction of wires 277 and 269, positive voltage on wire 279 being applied to the gate of silicon control rectifier SCR1, thus when switches RS1 and 260 are closed, causes the silicon controlled rectifier SCR1 to conduct, thereby energizing relay coil 257 and opening the contacts "B". In this manner, only one round can be fired with each trigger "pull". If firing in the full automatic mode is desired, switch 260 is opened so that the relay coil 257 is not energized, and the trigger circuit is maintained as long as the trigger is pulled.

The operation of the system can then continue as described.

It will thus be seen that systems have been provided with which the objects of the invention are achieved.

I claim:

1. A system for converting firearms having a mechanical firing mechanism to electrical ignition for use with rounds of electrically primed ammunition which comprises a drop in module to replace said firing mechanism which includes
an outer housing,
a power source in said housing,
circuitry means connected to said power source,
said circuitry means being of all solid state construction, and
said circuitry means is engaged with a round of ammunition to provide electrical power thereto to initiate combustion.

2. A system for converting firearms as defined in claim 1 in which said power source is a battery carried within said housing.

3. A system for converting firearms as defined in claim 1 in which said circuitry means includes at least one safety switch.

4. A system for converting firearms as defined in claim 1 in which said circuitry means provides an intermittent flow of electricity for ammunition combustion initiation.

5. A system for converting firearms as defined in claim 1 in which said circuitry means provides a continuous flow of electricity for ammunition combustion initiation.

6. A system for converting firearms as defined in claim 1 in which light indicating means are provided to indicate whether the system is in condition for use.

7. A system for converting firearms as defined in claim 3 in which a plurality of safety switches are provided of the single pole double throw type, and said switches are internally connnected to provide a variety of combinations of switch position.

* * * * *

UNITED STATES PATENT AND TRADEMARK OFFICE

CERTIFICATE OF CORRECTION

PATENT NO. : 4,730,407

DATED : March 15, 1988

INVENTOR(S) : Dean S. DeCarlo

It is certified that error appears in the above-identified patent and that said Letters Patent is hereby corrected as shown below:

The sheet of drawing consisting of Figs. 4, 5, 6 and 7, should be deleted and therefor, substitute the attached sheets of drawing consisting of Figs. 4, 5, 6 and 7.

Signed and Sealed this

Fourth Day of July, 1989

*Attest:*

*Attesting Officer*

DONALD J. QUIGG

*Commissioner of Patents and Trademarks*